US006860126B2

(12) United States Patent
Ling

(10) Patent No.: US 6,860,126 B2
(45) Date of Patent: Mar. 1, 2005

(54) COMBINATION LOCK WITH DIAL DISPLAYING WINDOW

(76) Inventor: Renny Tse-Haw Ling, c/o Sinox Co., Ltd., P.O. Box 4-50, Chun-Ho City, Taipei Hsien (TW)

( * ) Notice: Subject to any disclaimer, the term of this patent is extended or adjusted under 35 U.S.C. 154(b) by 0 days.

(21) Appl. No.: 10/234,619

(22) Filed: Sep. 4, 2002

(65) Prior Publication Data

US 2004/0089032 A1 May 13, 2004

(51) Int. Cl.[7] ..... E05B 37/02

(52) U.S. Cl. ..... 70/30; 70/51; 70/52; 70/312; 70/330; 70/331; 70/333 A; 70/446

(58) Field of Search ..... 70/18, 30, 23–26, 70/51–56, 311, 312, 330, 331, 333 A, 432, 443, 444, 446, DIG. 43, DIG. 56, DIG. 59

(56) References Cited

U.S. PATENT DOCUMENTS 605,493 A * 6/1898 Le Vino ..... 70/30
1,240,146 A * 9/1917 Jackson ..... 70/30
1,267,894 A * 5/1918 Olson ..... 70/30
1,411,111 A * 3/1922 Long ..... 70/226
3,851,507 A * 12/1974 Gehrie ..... 70/316
3,952,562 A * 4/1976 Snow ..... 70/476
4,287,734 A * 9/1981 Herriott ..... 70/333 A
4,970,883 A * 11/1990 Johnson ..... 70/30
5,359,867 A * 11/1994 Ling et al. ..... 70/28
5,749,251 A * 5/1998 Keefe ..... 70/30
6,408,660 B1 * 6/2002 Lai ..... 70/30

FOREIGN PATENT DOCUMENTS

DE 380980 * 9/1923 ..... 70/30

* cited by examiner

*Primary Examiner*—Lloyd A. Gall
(74) *Attorney, Agent, or Firm*—Senniger Powers

(57) ABSTRACT

A combination lock with a dial displaying window which is directed to a combination lock with the installation of a dial matching frame placed across all the dials and having at least one window for the users to check the combination numerals or symbols on the dials through the window for unlocking the combination lock. The dial matching frame may be differently constructed to provide the window with the displaying function. A magnification lens may be mounted on the window to further enhance the effectiveness during utilization.

4 Claims, 5 Drawing Sheets

COMBINATION LOCK WITH DIAL DISPLAYING WINDOW

BACKGROUND OF THE INVENTION

1. Field of the Invention

This invention is related to a dial matching device for a combination lock, in particular, a dial matching device that helps the user to more accurately identify the corresponding locations of all the dials for unlocking the combination lock, 2. Description of the Related Art A combination lock is a locking apparatus utilizing dials which must be adjusted to the pre-designated locations of preset numerals or symbols for unlocking the combination lock.

The conventional combination lock usually includes indication arrows, symbols, grooves or protrusions as the dial matching device, which is referred to as "dial matching indication unit" hereinafter, on one or both sides of the parallel dials of the combination lock to identify the locations for matching the dials with the combination. The user adjusts the dials of the combination lock to the locations for matching the dials with the preset combination with reference to the dial matching indication unit so as to unlock the combination lock. In other words, as long as each of the dials is accurately matched with the preset numeral or symbol at the location indicated by the dial matching indication unit, the combination lock may be unlocked Generally, the "dial matching indication unit" is provided only adjacent to the outermost dial(s), that is, only the outermost dial(s) may be directly identified by the adjacent dial matching indication unit. Nonetheless, the dials in the middle, or those not adjacent to the dial matching indication unit, may still be checked by visually extending the identification direction pointed out by the dial matching indication unit, so that the user may complete the dial matching process. Such kind of dial matching indication unit has been used in the combination lock for a long time.

However, such a dial matching indication unit is not an ideal solution for the combination lock. Usually, the dial matching indication unit is not very apparent to the user and thus, some drawbacks may occur. For example:

1. When the grooves or protrusions are used on the surface of the combination lock as the dial matching indication unit, if the depth or height thereof is too small, the visual effect for identification may not be significant enough; on the other hand, if the depth of the grooves is too large, dust may be accumulated therein; if the height of the protrusions is too large, they may appear awkward.
2. If the dial matching indication unit is printed on the surface of the lock or in the form of a sticker, they are easily damaged during the usage of the lock and may become unclear or even disappear and thus, the identification function thereof is deteriorated.
3. Even if a user knows that the designated combination number of the dials must exactly match with the indication unit in order to unlock the locks, combination locks usually allow a minute amount of displacement such that the locks still cannot be unlocked even if the indicating unit has pointed to the side edges of the designated combination number with excessive displacement.

BRIEF SUMMARY OF THE INVENTION

A primary objective of this invention is to overcome the above drawbacks and provide a dial matching indication device for a combination lock to clearly mark the reference position for matching the dials, such that the user may quickly and accurately identify the combination of a series of numerals (or symbols) of the dials through the dial matching indication device for unlocking the combination lock. In addition, the dial matching identification function provided by the device of this invention will not be easily deteriorated by the usage of the lock.

According to the above objective, this invention provides a window-type dial matching identification mechanism, comprising a dial matching frame which is provided on a lock mechanism. The frame has at least one window placed across all the dials at a predetermined matching position, so that the user can quickly and accurately identify the combination of the dials through the window for unlocking the lock.

The structures and characteristics of this invention can be realized by referring to the appended drawings and explanations of the preferred embodiments.

DETAILED DESCRIPTION OF THE INVENTION

Figure 1:
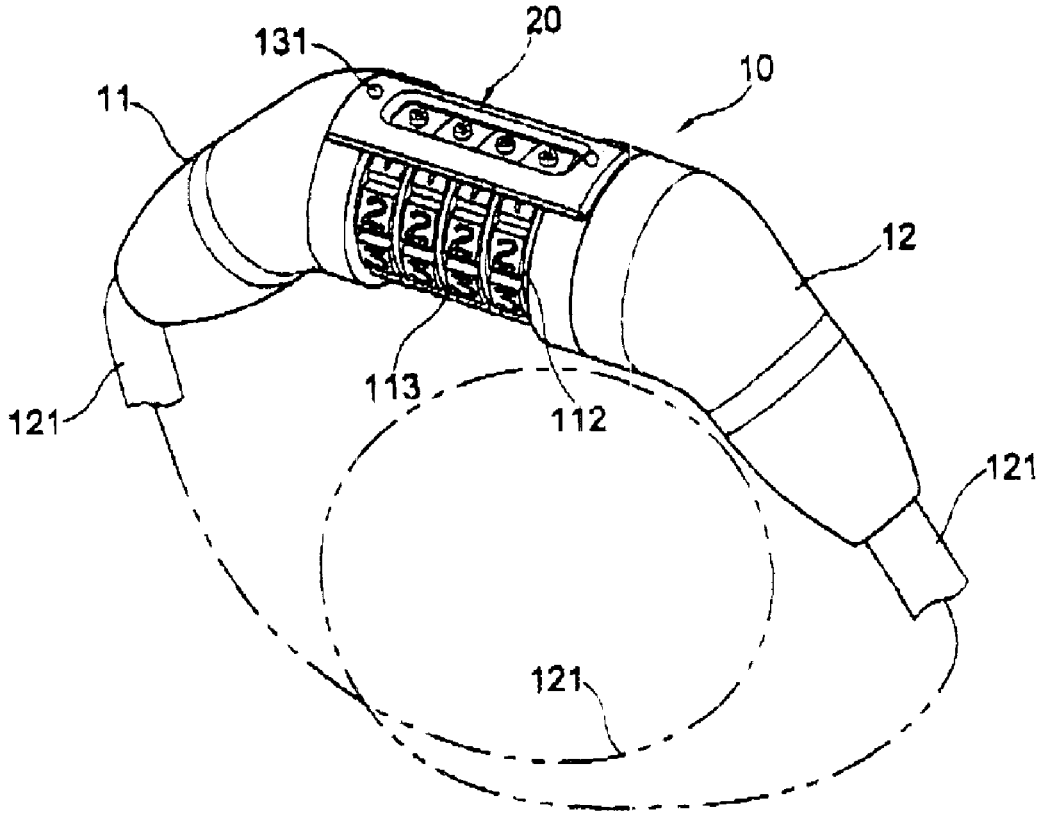
FIG. 1 is a schematic view showing one of the preferred embodiments according to this invention.

FIG. 1 shows a combination lock 10 with a dial matching frame 20 thereon such that the user can clearly identify the combination of the dials for unlocking the lock. As illustrated in the figures, the combination lock 10 includes a lock body 11 and a latch 12, wherein the lock body 11 further has a locking hole 111 and a plurality of parallel dials 112 provided around the exterior of the lock body 11. Each of the dials 112 can be Independently rotated with respect to the lock body 11 and is provided with numerals 113 (or symbols) surrounding the surface thereof. When each of the dials 112 is rotated to a preset combination at the predetermined dial matching position, the lock body 11 may be unlocked. Otherwise, when one or more numerals 113 of the dials 112 at the matching position do not match with the preset combination, the lock body 11 remains at the locked state. The application of this kind of combination lock 10 is well known to the persons skilled in the art and thus, the detailed description is not provided.

Figure 2:
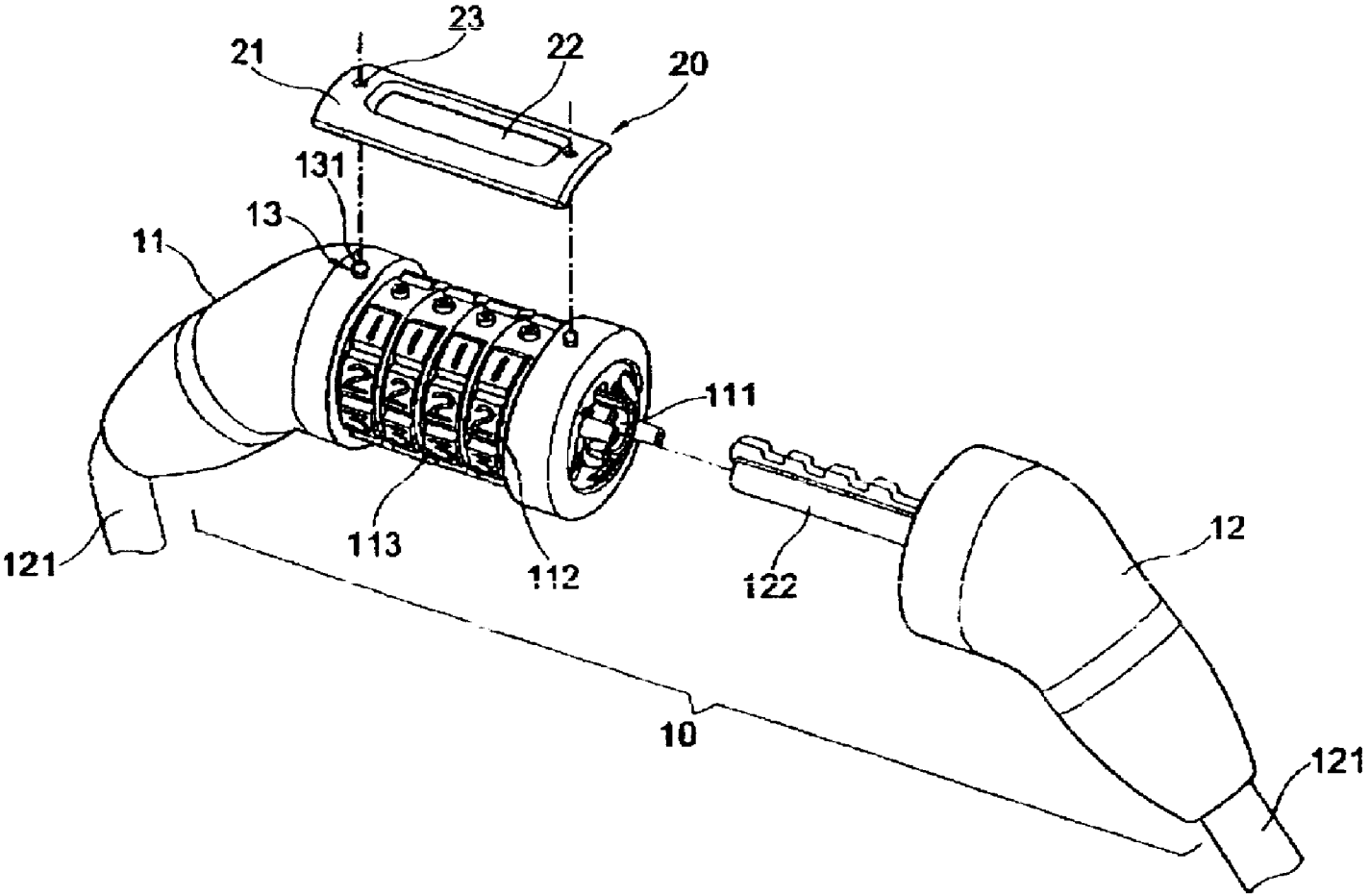
FIG. 2 is an exploded view showing the structure of the embodiment of FIG. 1.
Figure 3:
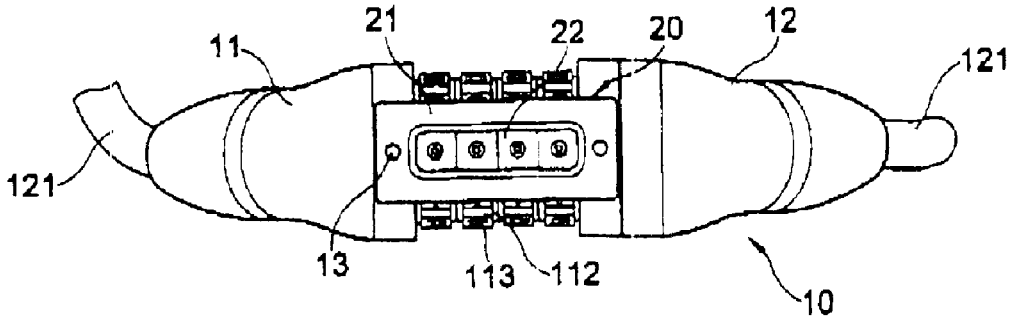
FIG. 3 is a top plan view showing the structure of the embodiment of FIG. 1.

The combination lock 10 also includes a latch 12. According to this invention, the latch 12 may be a U-shaped rigid body or a flexible wire, such as a steel cable. In the preferred embodiments discussed in this invention, the latch 12 includes a steel cable 121 having a desired length with one end thereof connected with the lock body 11, and the other end of the latch 12 is provided with a locking rod 122 which may be inserted into the locking hole 111 to be locked by the lock body 11 when it is adjusted to the locked state. Thus, the lock body 11 and the latch 12 are locked together and form a closed loop. Of course, the locking rod 122 may be released from the locking hole 111 when the lock body 11 is at the unlocked state, In addition to the lock body 11 and the latch 12, the combination lock 10 disclosed in the preferred embodiment of this invention further comprises a dial matching frame 20 which is used to provide the reference position and enhance the identifiability for the user to match the dials 112. Accordingly, the user can clearly identify a set of numerals 113 on the dials 112 through the dial matching frame 20. Generally, the dial matching frame 20 includes a frame body 21 which defines at least one window 22 enclosed by an appropriate perimeter. As illustrated in FIGS. 2 and 3, after the dial matching frame 20 is mounted on the lock body 11 (to be further described later), the numerals 113 can be clearly identified by the user through the window 22. The size of the window 22 can be appropriately designed in view of the dimension of the numerals 113 on the dials 112, such that under normal viewing angle, the user can only see one set of the numerals 113 on the dials 112. That is, only the set of numerals 113 adjusted to the matching position can be seen through the window 22.

In the preferred embodiments of this invention, the dial matching frame 20 and the lock body 11 may be separable components, wherein the dial matching frame 20 and the lock body 11 respectively have mating holes 23 and mating blocks 13 of the same number at corresponding locations such that the dial matching frame 20 can be mounted on the lock body 11 by inserting the mating blocks 13 into the mating holes 23. In actual application, the mating block 13 may further incorporate a resilient head 131 which is deformable upon an external force for passing through the mating hole 23, so that the dial matching frame 20 can be mounted on the lock body 11.

Figure 4:
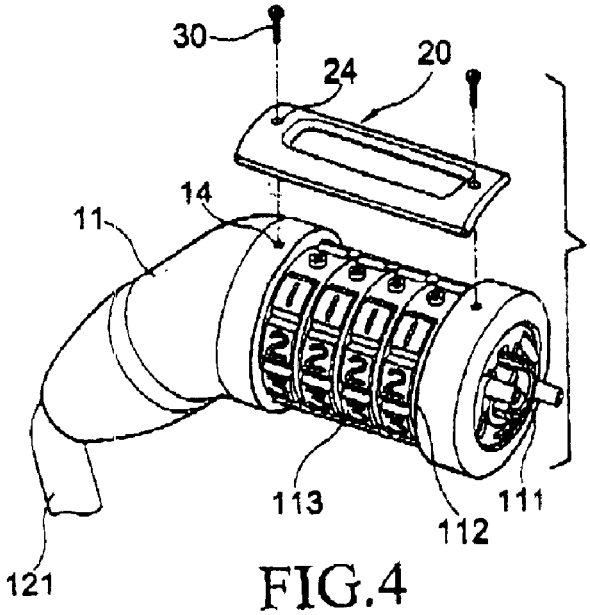
FIG. 4 is a schematic view showing another preferred embodiment according to this invention.

As shown in FIG. 4, each of the dial matching frame 20 and the lock body 11 may have a fastening hole 14 and 24, respectively, at a corresponding location, and a fastening member 30 is further provided to pass through the two fastening holes 14 and 24 so as to fasten the dial matching frame 20 on the lock body 11.

Figure 5A:
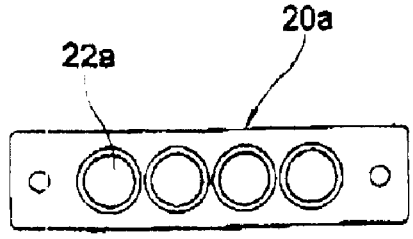
FIGS. 5A and 5B show the possible structures of the dial matching frames utilized in the preferred embodiments for a combination lock.
Figure 5B:
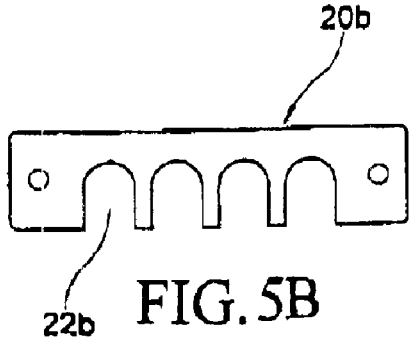

FIGS. 5A and 5B show the dial matching frames 20*a* and 20*b* with different structures as compared with that disclosed in FIG. 3. As shown in FIG. 5A, the dial matching frame 20*a* has small windows 22*a* on its surface in the same number with that of the dials 112. Each of the small windows 22*a* is designed according to the type and size of the numerals 113, and may also be designed into various shapes to present unique and novel visual effects. In FIG. 5A, the small windows 22*a* are round, and of course may be other geometrical shapes or specially designed shapes. Further, as illustrated in FIG. 5B, instead of the enclosed circular shape shown In FIG. 5A, the small windows of the dial matching frame 20*b* may be in the form of a semicircular opening 22*b*. Although the dial matching frame 20*b* with the opening 22*b* may not completely encircle the numerals 113, the numerals 113 of the dials 112 at the dial matching position can still be clearly identified in such a design.

Figure 6:
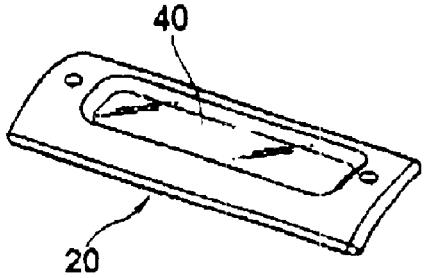
FIG. 6 is another type of the dial matching frame utilized in the preferred embodiment of this invention.

In view of the above, it is understood that the dial matching frame 20, 20*a* or 20*b* is a dial displayer provided on the combination lock 10 so as to facilitate the user to match the combination of the lock 10. The dial matching frame 20, 20*a* or 20*b* should have at least one displaying window 22, 22*a* or opening 22*b*. The dial matching frame 20 may further include a lens 40 Inserted thereinto, as shown in FIG. 6. Particular, the lens 40 may be a convex lens to magnify the numerals 113 through the window 22. Moreover, the dial matching frame 20 may be made of a fluorescent material such that the combination lock 10 can still be used in a dark environment since the display of the numerals 113 are enhanced by the light emitting from the dial matching frame 20.

Figure 7:
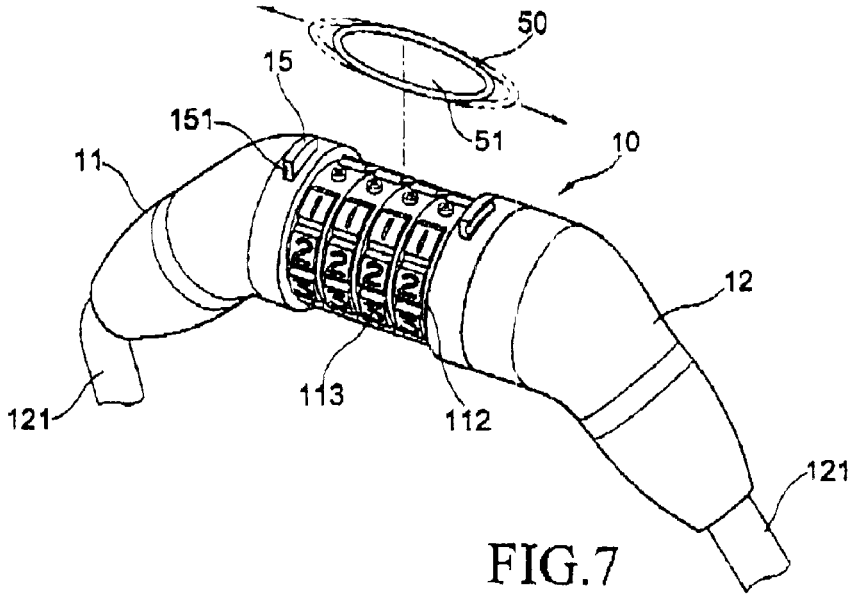
FIG. 7 is a schematic view showing yet another preferred embodiment according to this invention.

FIG. 7 shows another type structure of the dial matching frame 20. As illustrated in the drawing, the dial matching identification mechanism may be a resilient member 50 with restorability after stretching. In addition, the lock body 11 has two positioning parts 15 at the predetermined dial matching positions on both sides of the dials 112, respectively. The resilient member 50 is stretched and wrapped around the positioning parts 15. The resilient member 50 thus forms a frame body surrounding the dial matching position and defines a window 51 to provide the indication function. In order to have stable attachment so that the resilient member 50 will not be easily or unexpectedly separated from the positioning parts 15, the resilient member 50 should have shorter length than the distance between the two positioning parts 15. Therefore, the resilient member 50 must be properly stretched prior to being wrapped around the positioning parts 15 and thus, the resilient member 50 is constantly under the recovering force and is stably engaged with the positioning parts 15. Furthermore, the positioning parts 15 may comprise recessed grooves 151 so that the resilient member 50 can be inserted thereinto and will not be separated very easily.

Accordingly, not only the dial matching frame 20 made of hard material can provide the user with dial matching function for the combination lock 10, the resilient member 50 with restorability after stretching may also be used to achieve the identical function.

Figure 8:
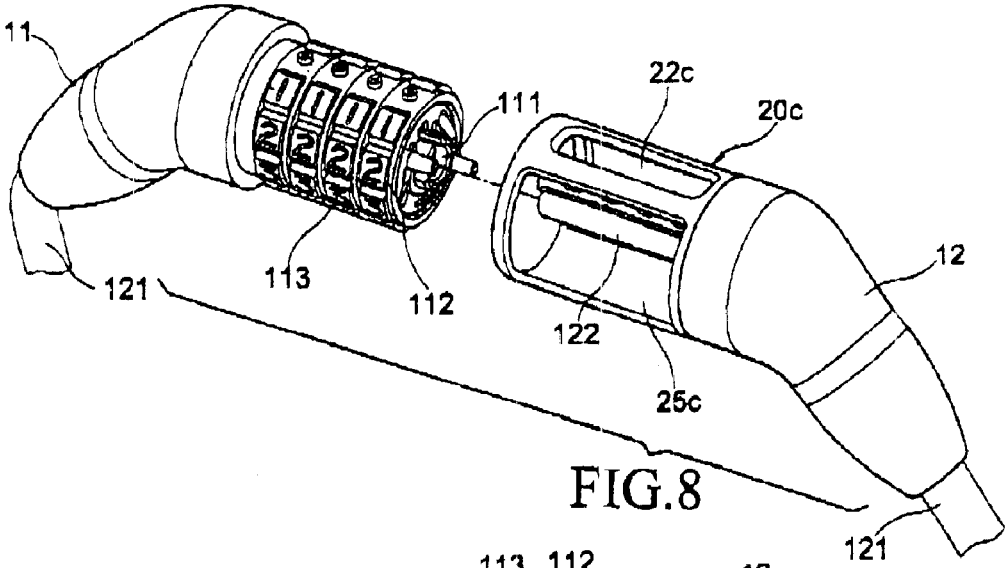
FIG. 8 is a schematic view showing a further preferred embodiment according to this invention.

FIG. 8 discloses another preferred embodiment of this invention. The latch 12 has an integrally formed dial matching frame 20*c*. The latch 12 also includes the steel cable 121 with one end thereof connected with the lock body 11. The other end of the latch 12 is provided with the locking rod 122 which may be inserted into the locking hole 111 to be locked by the lock body 11 when it is adjusted to the locked state. At this time, the latch 12 is fixed with the lock body 11. The locking rod 122 may be released from the locking hole 111 when It is at the unlocked state.

Figure 9:
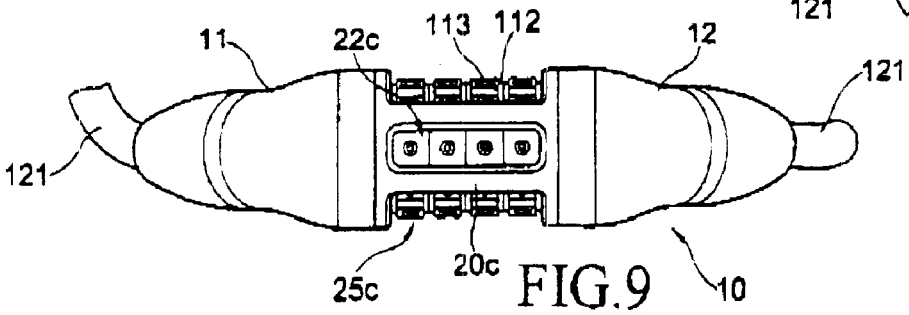
FIG. 9 is a schematic assembly view showing the embodiment of FIG. 8.

Alternatively, the dial matching frame 20*c* may be integrally formed with the lock body 11. In either way, the window 22*c* of the dial matching frame 20*c* is set to be at the dial matching position above the dials 112 when the locking rod 122 is inserted into and locked within the locking hole 111, as shown in FIG. 9. The dial matching frame 20*c* may be constructed as that shown in the figure as an annular framework surrounding the latch 12. The dial matching frame 20*c* has not only an engraved window 22*c*, but also dialing holes 25*c* for the user to rotate the dials 112.

This kind of dial matching frame 20*c* provides the function of identifying the matching position of the dials for the user through the window 22*c*, it also provides certain degree of protection over the latch 12 to prevent damage thereto due to collision between the latch 12 and other articles.

Figure 10:
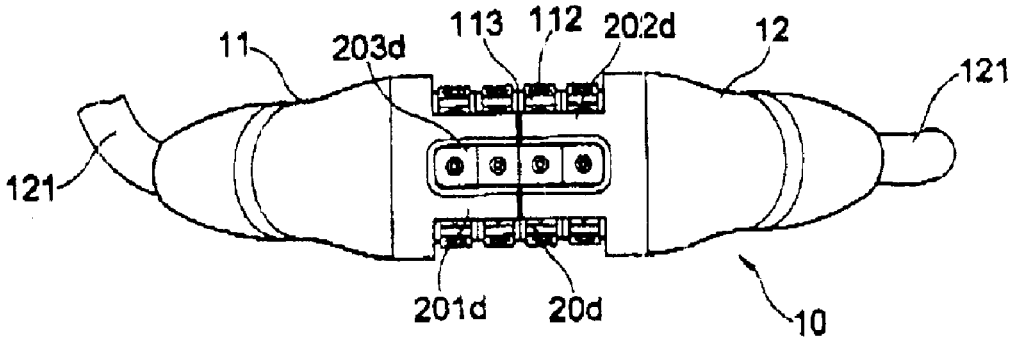
FIG. 10 is a schematic view showing a further preferred embodiment according to this invention.

FIG. 10 illustrates another type of preferred embodiment for a dial matching frame 20*d* according to this invention. The overall dial matching frame 20*d* is not solely extended from the lock body 11 or the latch 12, but combined by two half frames 201*d*, 202*d* extending from the lock body 11 and the latch 12 respectively. Thus, when the locking rod 122 is inserted into the locking hole 111, the two half frames 201*d* and 202*d* match with each other above and is placed across all the dials 112 at the predetermined dial matching position and form at least one window 203*d* above the dials 112 in order to show the numerals 113 thereon.

In other words, the dial matching frame 20*d* is formed by two concave plates extending toward each other from the lock body 11 and the latch 12 respectively. It is not integrally formed in one piece.

Figure 11:
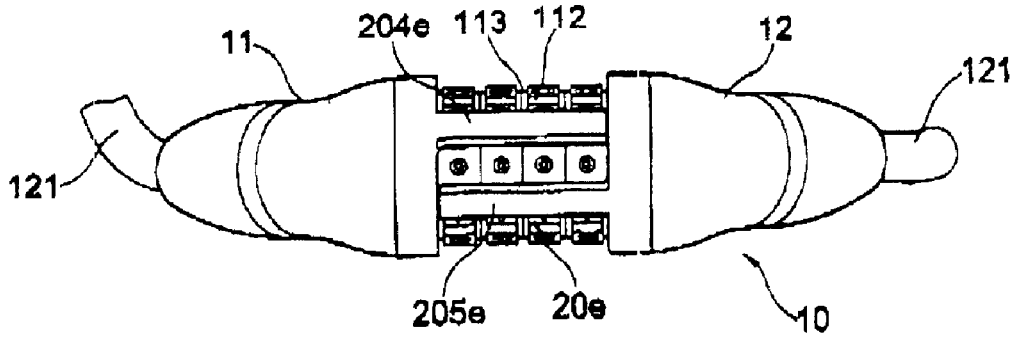
FIG. 11 is a schematic view showing the other preferred embodiment according to this invention.

FIG. 11 discloses a modified structure based on the previous preferred embodiment. The dial matching frame 20*e* is formed by two straight plates 204*e* and 205*e* extending from the lock body 11 and the latch 12 respectively and misaligned with each other.

It should be pointed out that, the lens inserted into the dial matching frame as shown in FIG. 6 and the use of a fluorescent material to make the dial matching frame, may also be applied to the dial matching frames 20*c*, 20*d* as shown In FIGS. 8 and 10 so as to enhance the displaying effects of the combination numerals.

This invention provides a dial matching frame to be utilized on a combination lock. It is a dial matching indication device that clearly marks the reference position for matching the dials. Therefore, the user may quickly and accurately Identify the combination of a series of numerals (or symbols) of the dials through the dial matching indication device for unlocking the combination lock. In addition, the dial matching identification function provided by the device of this invention will not be easily deteriorated by the usage of the lock.

This invention is related to a novel creation that makes a breakthrough in the art. Aforementioned explanations, however, are directed to the description of preferred embodiments according to this invention. Since this invention is not limited to the specific details described in connection with the preferred embodiments, changes and implementations to certain features of the preferred embodiments without altering the overall basic function of the invention are contemplated within the scope of the appended claims.

| | |
|---|---|
| 10 | combination lock |
| 11 | lock body |
| 111 | locking hole |
| 112 | dials |
| 113 | numerals |
| 12 | latch |
| 121 | steel cable |
| 122 | locking rod |
| 13 | mating blocks |
| 14 | fastening holes |

-continued

| | |
|---|---|
| 15 | positioning parts |
| 151 | recessed grooves |
| 20 | dial matching frame |
| 20a | dial matching frame |
| 20b | dial matching frame |
| 20c | dial matching frame |
| 20d | dial matching frame |
| 20e | dial matching frame |
| 201d | half frame |
| 202d | half frame |
| 203d | window |
| 204e | straight plate |
| 205e | straight plate |
| 21 | frame body |
| 22 | window |
| 22a | window |
| 22b | opening |
| 22c | window |
| 23 | mating holes |
| 24 | fastening hole |
| 25c | dialing holes |
| 30 | fastening member |
| 40 | lens |
| 50 | resilient member |

What is claimed is:

1. A combination lock with a dial displaying window, comprising:

a lock mechanism having a locking hole and a plurality of adjacent dials, wherein the lock mechanism is convertible between an unlocked state and a locked state by rotating the dials;

a latch, having one end connected with the lock mechanism and another end to be inserted into the locking hole, such that the latch is adapted to be locked by the lock mechanism when it is at the locked state, and the latch is adapted to be removed from the locking hole when the lock mechanism is at the unlocked state; and one free end of the latch having a dial matching frame, such that when the free end of the latch is inserted into the locking hole, the dial matching frame is placed across all the dials, wherein the dial matching frame has at least one window at a predetermined matching position over the dials.

2. The combination lock with a dial displaying window according to claim 1, wherein the at least one window is an engraved region.

3. The combination lock with a dial displaying window according to claim 1, wherein the dial matching frame is an annular framework surrounding the latch and further comprises dialing holes.

4. The combination lock with a dial displaying window, according to claim 1, wherein the at least one window is further inserted thereinto a transparent lens.

* * * * *